United States Patent [19]

Gerstner

[11] Patent Number: 4,570,905

[45] Date of Patent: Feb. 18, 1986

[54] FLOOR JACK ASSEMBLY FOR REMOVING AUTO DIFFERENTIALS

[76] Inventor: Norman G. Gerstner, P.O. Box 2406, Soldotna, Ak. 99669

[21] Appl. No.: 642,089

[22] Filed: Aug. 20, 1984

[51] Int. Cl.[4] ..... B66F 7/26

[52] U.S. Cl. ..... 254/134; 254/DIG. 16

[58] Field of Search ..... 254/134, DIG. 16; 411/389, 411, 424

[56] References Cited

U.S. PATENT DOCUMENTS

| | | | |
|---|---|---|---|
| 389,028 | 9/1888 | Wallace | 411/389 |
| 2,748,459 | 6/1956 | Orr | 254/134 X |
| 3,062,500 | 11/1962 | Arnes et al. | 254/134 X |
| 3,095,182 | 6/1963 | Platt | 254/134 |
| 3,559,981 | 2/1971 | Abshear | 254/134 X |
| 4,269,394 | 5/1981 | Gray | 254/134 |

*Primary Examiner*—Frederick R. Schmidt
*Assistant Examiner*—Steven P. Schad
*Attorney, Agent, or Firm*—James D. Givnan, Jr.

[57] ABSTRACT

A floor jack equipped with a jack assembly including positionable arms having posts insertably engageable with bolt hole openings in one end of a vehicle drive line component. A rest is vertically and horizontally positionable to upwardly engage the other end of the drive line component. The rest carries a chain hold-down. A rail is arcuately positionable on a platform and a shoe is positionable along the rail and adjustably supports the rest.

5 Claims, 5 Drawing Figures

FLOOR JACK ASSEMBLY FOR REMOVING AUTO DIFFERENTIALS

BACKGROUND OF THE INVENTION

The present invention pertains generally to floor jacks of the type used in the automotive field.

A significant problem exists for auto mechanics involved in the removal of heavy drive line components such as differentials and transmissions. The prior art includes modified floor jacks directed toward solving the problem of supporting a heavy drive line component during the removal of same from an elevated automobile. Such known jacks do not provide for the limited clearance usually encountered as access to the differential or transmission is often hindered by other portions of the auto.

The various arrangements used to remove a differential or transmission often incur the risk of injury to the mechanic. While modifications or attachments to floor jacks are known to be in the prior art such equipment has not found wide acceptance in the industry for one reason or another and presently differential and transmission removal is commonly done in a haphazard manner.

U.S. Pat. Nos. 4,269,394; 4,166,608; 3,559,981; 3,040,908; 3,012,311 and 2,747,837 disclose attempts to remedy the above problems.

SUMMARY OF THE PRESENT INVENTION

The present invention is embodied in a floor jack mounted assembly for convenient attachment to a drive line component regardless of limited working space encountered in removal of such a component.

The present jack incorporates known floor jack construction to provide a positionable base on which the present assembly is carried for positioning subjacent the component being removed.

A platform of the present apparatus has an upright plate thereon on which are mounted adjustable arms which are adapted at their upper ends for inserted engagement with the differential carrier in a positive manner. Modified curves arms accommodate carriers of other than symetrical shape.

The opposite end of the component is supportable within a rest which is positionable both horizontally and vertically to accommodate a wide range of components being removed from the auto drive line. The rest includes a hold-down to secure the component on the rest. The rest is slidably mounted on a rail which may move about a vertical axis to locate the rest below the reduced end of the component regardless of same being laterally offset from a component centerline.

Important objectives include the provision of a jack arrangement for use by auto mechanics which may be coupled to a wide range of automotive differentials in a rapid and convenient manner; the provision of an automotive jack which utilizes post carried at the ends of adjustable arms which posts engage openings in the flange of the differential carrier; the provision of a jack for removing heavy drive line components from autos, trucks, etc., which supports the forward or reduced end of the carrier in a rest positionable within multiple planes to accommodate a wide array of carrier configurations.

DETAILED DESCRIPTION OF THE PREFERRED EMBODIMENTS

Figure 2:
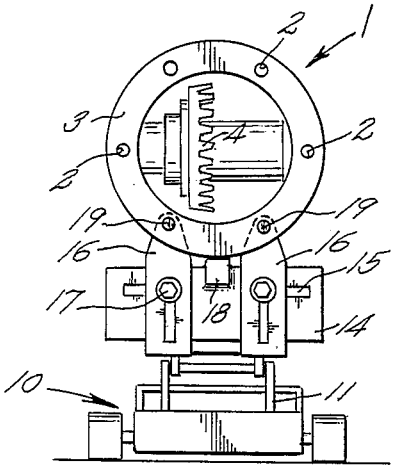
FIG. 2 is a left hand elevational view of FIG. 1.
Figure 1:
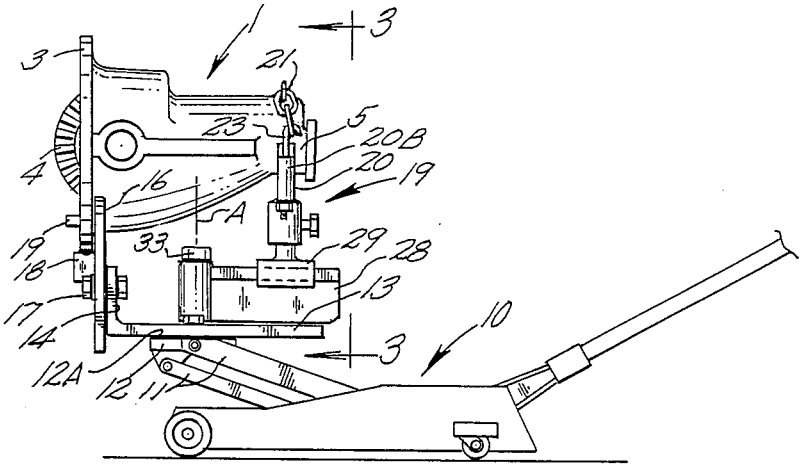
FIG. 1 is a side elevational view of the present jack.
Figure 3:
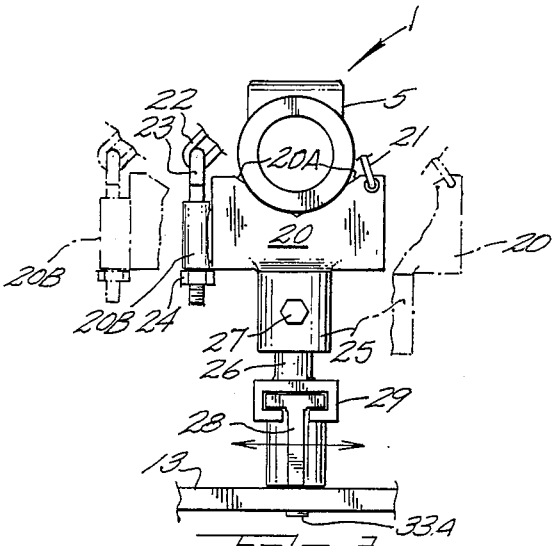
FIG. 3 is a vertical elevational view taken along line 3—3 of FIG. 1.

With continuing attention to the drawing wherein reference numerals indicate parts similarly hereinafter identified, the reference numeral 1 indicates generally a drive line component such as the differential unit shown. The differential carrier is a cast housing the configuration and size of which will vary considerably between vehicle makes and models.

The differential is shown with its cover removed leaving cover bolt openings at 2 exposed. Said openings are spaced about a carrier flange at 3. A ring gear is at 4. A reduced forward end 5 of the carrier houses a pinion front bearing.

With attention now to the present jack, a floor jack component is indicated generally at 10 having the usual parallelogram arms 11 which support a base 12 with a lifting surface 12A.

In combination with the floor jack base 12 is a platform 13 suitably mounted on the base in a secure manner. Platform 13 includes an upright flange 14 having slotted openings 15 for adjustable support of arm means at 16. Flange 14 is additionally provided with a projection 18 on which carrier flange 13 may be supported.

The above noted arm means comprises a pair of arms 16 with each arm having a post 19 at the arm upper end which projects horizontally to extend through a bolt receiving opening 2 in carrier flange 3. As such openings are not threaded, no risk of thread damage is encountered. The arm upper ends are somewhat tapered to assure proper clearance with the carrier exterior. The arms define elongate openings and receive fastener assemblies at 17 which also pass through openings 15 in platform flange 14. Accordingly, a wide range of arm positions is possible to permit use of the present jack with a substantial number of differential vehicle makes and models.

The forward end 5 of the differential is characteristically of reduced size and must be supported in a manner permitting downward removal of the differential unit in a horizontal position. A support assembly generally at 19 includes a rest 20 serves to confine component forward end 5 in place by reason of downwardly sloped converging edges 20A. A hold-down is provided in a chain segment 21 having an adjustable end 22 carried by a hook 23 in threaded engagement with a tube 20B on the rest 20 with a lock nut at 24. A collar 25 of the rest is telescopically engaged with a post 26 with a set screw at 27 maintaining the collar and post in the desired relationship. Post 26 is adapted for horizontal positioning by reason of being mounted on a shoe 29 which, in turn, is slidably carried by a T-shaped rail 28. Said rail is positionable about an upright axis A which is coaxial with a locking member 33 in engagement at its lower end 33A with platform 13. Accordingly, tightening of locking member 33 secures rail 28 in an adjusted position about axis A with the lower edge of the rail in abutment with the platform. This adjustable feature is practical when the differential carrier or other drive line component has a forward end 5 laterally offset from longitudinal axis of the component.

In use the floor jack is positioned below a raised vehicle. The arms 16 are manually positionable to permit the posts 19 thereon to be aligned with the differential flange openings 2 whereupon the jack is advanced to seat the posts within the openings. The rim of the flange is in rested engagement with projection 18. Subsequently the rest 20 is moved into upward abutment with the forward end of the differential and locked in place and the hold-down tightened over said forward end. The coupling of the jack to the differential is readily accomplished regardless of restricted working spaced and limited clearance between the differential carrier and other vehicle components.

Figure 4:
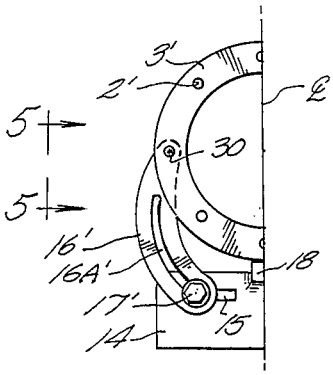
FIG. 4 is a view similar to FIG. 2 but broken away along a verticle centerline and showing a modified arm of the present jack.
Figure 5:
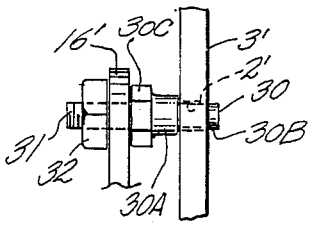
FIG. 5 is a vertical elevational view taken along line 5—5 of FIG. 4.

In FIGS. 4 and 5 a modified arm means is shown at 16' in which each arm is of curved configuration having a slot 16A' therein through which a fastener assembly 17' extends. The arm includes a post 30 positionable within a bolt receiving opening 2' in a carrier flange 3'. The unseen arm in FIG. 4 would be a mirror image to that shown. The modified arms are of curvilinear shape to circumvent various carrier appendages. The posts 30 are in threaded engagement with the arm ends by reason of a threaded stud 31 receiving a nut element 32. The post 30 has different diameters at 30A and 30B for different sized openings 2'. Flats 30C are provided for wrenching purposes.

While I have shown but one embodiment of the invention it will be apparent to those skilled in the art that the invention may be embodied still otherwise without departing from the spirit and scope of the invention.

Having thus described the invention, what is desired to be secured in Letters Patent is:

I claim:

1. A jack assembly for installation of an automotive floor jack for removing a vehicle drive line component which defines bolt hole openings, said jack assembly comprising, a platform for securement to a lifting surface of the floor jack, arm means including upright arms with each arm having a post adjacent an arm end and individually insertable through the openings in the driveline component, means adjustably mounting said arm means on said platform, a support assembly on said platform and including a rail, means coupling said rail to said platform and including a vertically disposed pivot member on which one end of said rail is mounted to permit horizontal positioning of said rail about said pivot member, shoe means adjustably mounted on said rail, a rest carried by said shoe means and on which a drive line component may be partially supported, hold-down means on said rest for engagement with said drive line component, and vertically adjustable means coupling said shoe to said rest to permit vertical positioning of said rest preparatory to engagement with the drive line component.

2. The jack assembly claimed in claim 1 wherein said adjustable mounting means mounting said arm means to said platform is embodied in open areas formed in said platform and in said arm means and fasteners extending through said open areas whereby the arm means may be adjusted vertically and laterally relative the platform to accommodate drive line components of different size and bolt hold location.

3. The jack assembly claimed in claim 2 wherein said upright arms comprise a pair of curved arms.

4. The jack assembly claimed in claim 1 wherein said posts are in detachable engagement with their respective arms.

5. The jack assembly of claim 4 wherein said posts each have segments of different diameter to accommodate drive line components have differently size bolt hole openings.

* * * * *